US008573016B2

(12) United States Patent
Wendt et al.

(10) Patent No.: US 8,573,016 B2
(45) Date of Patent: Nov. 5, 2013

(54) COMPRESSION ROLLING MILL HAVING A DRIVE UNIT

(75) Inventors: Stefan Wendt, Hilchenbach (DE); Frank Möllering, Hilchenbach (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/519,020

(22) PCT Filed: Dec. 21, 2010

(86) PCT No.: PCT/EP2010/070441

§ 371 (c)(1), (2), (4) Date: Jul. 31, 2012

(87) PCT Pub. No.: WO2011/076817

PCT Pub. Date: Jun. 30, 2011

(65) Prior Publication Data

US 2012/0285214 A1 Nov. 15, 2012

(30) Foreign Application Priority Data

Dec. 23, 2009 (DE) ..... 10 2009 060 237

(51) Int. Cl.
*B21B 31/00* (2006.01)
*B21B 35/00* (2006.01)

(52) U.S. Cl.
USPC ..... 72/237; 72/249

(58) Field of Classification Search
USPC ..... 72/237, 249
See application file for complete search history.

(56) References Cited

U.S. PATENT DOCUMENTS

| | | | | | |
|---|---|---|---|---|---|
| 664,645 | A | * | 12/1900 | Kennedy | 72/249 |
| 1,880,468 | A | * | 10/1932 | Nye | 72/249 |
| 2,124,677 | A | * | 7/1938 | Talbot | 72/249 |
| 4,152,918 | A | | 5/1979 | Tanaka et al. | |
| 4,669,294 | A | * | 6/1987 | Wilson | 72/249 |
| 2006/0243015 | A1 | | 11/2006 | Habermann et al. | |

FOREIGN PATENT DOCUMENTS

| | | |
|---|---|---|
| DE | 69005640 | 5/1994 |
| EP | 1606067 A | 8/2006 |
| GB | 750996 A | 6/1956 |
| WO | 9104107 A | 4/1991 |

* cited by examiner

*Primary Examiner* — Teresa M Ekiert
(74) *Attorney, Agent, or Firm* — Lucas & Mercanti, LLP; Klaus P. Stoffel

(57) ABSTRACT

The invention relates to a compression rolling mill for compressing a metal strand sideways, having a pair of mutually engaging rollers (9, 10), arranged perpendicular to the center axes, connected to a rotary drive (31, 32; 34) by means of articulated shafts (29, 30), characterized in that the two rollers (9, 10) are connected to the rotary drive (31, 32; 34) by means of a gearbox (27, 28) adjustable together with the rollers (9, 10) and by means of articulated shafts (29, 30) each connected to one of the two gearboxes (27, 28), wherein the articulated shafts (29, 30) are inclined at an acute angle to the horizontal.

18 Claims, 2 Drawing Sheets

COMPRESSION ROLLING MILL HAVING A DRIVE UNIT

The present application is a 371 of International application PCT/EP2010/070441, filed Dec. 21, 2010, which claims priority of DE 10 2009 060 237.2, filed Dec. 23, 2009, the priority of these applications is hereby claimed and these applications are incorporated herein by reference.

BACKGROUND OF THE INVENTION

The Invention concerns a compression rolling mill for laterally compressing a metal strand with a pair of rolls that are arranged with their center axes vertical, that can be adjusted relative to each other, and that are connected to a rotary drive by means of cardan shafts.

Compression rolling mills of this type are realized to a great extent as vertical roll stands or compression roll stands with one or more crossheads.

EP 1 606 067 B1 discloses a compression rolling mill for hot working, which comprises a pair of rolls that are arranged with their center axes vertical, that can be adjusted relative to each other, and that are connected to at least one rotary drive by cardan shafts. This compression rolling mill is characterized in that the rotary drive for the two rolls is arranged in a stationary mount below the mill floor level, with each being drive-connected with the cardan shaft, and each with a fixed gearbox. Starting from a rotary drive, which consists of a heavy electric motor, the driving power is transmitted by means of a horizontally arranged, continuous, and pivoted drive shaft and bevel gear gearbox steps branched on both sides to the two cardan shafts inclined at an acute angle to the vertical, which in turn transmit their rotary motion to the compression rolls by the heads of the cardan shafts held in receivers for said shaft heads. This previously known compression rolling mill has the disadvantage that it requires a large installation space.

SUMMARY OF THE INVENTION

The objective of the invention is to improve a compression rolling mill of the aforementioned type in such a way that its installation is simplified.

In accordance with the invention, this objective is achieved by virtue of the fact that the two rolls are connected with the rotary drive by gearboxes that can be adjusted together with the rolls and by cardan shafts connected respectively with one of the two gearboxes, where the cardan shafts are inclined at an acute angle to the horizontal.

One advantage of the invention is that the compression rolls and the associated gearboxes are split up in separate assemblies. Another advantage of this new design is that the rotary motion is transmitted directly to the cardan, shafts by the step-up gears connected with a single drive motor via a synchronous shaft or by the step-up gears that are each driven by its own drive motor. Therefore, these can be arranged at an acute angle to the horizontal. This design makes it possible to eliminate the overall installation height otherwise arising from the cardan shafts being arranged at an angle to the vertical, and the design of the compression rolling mill in accordance with the invention allows a more compact construction compared to the prior art.

Advantageous refinements of the invention are disclosed in the dependent claims, the specification, and the drawings.

The rotary drive preferably comprises two drive motors, each of which is connected with one of the two cardan shafts, especially by a step-up gear.

In an advantageous alternative design, the two cardan shafts are each connected with gearboxes, and the gearbox belonging to one of the cardan shafts is connected by a synchronous shaft with the drive motor for the common drive of the two gearboxes. In another alternative, the two cardan shafts are connected with the drive motor by a common gearbox and a synchronous shaft connected to it. The gearboxes are designed, for example, as step-up gears and, for example, as pinion gear units.

In an advantageous refinement, the synchronous shaft is supported in a guide element, by which it is supported relative to the floor.

Preferably, the rotary drive is arranged below the mill floor level.

In another advantageous refinement, it is provided that a media chain is laid below the mill floor level. The media chain is connected with the gearboxes arranged between the cardan shafts and the compression rolls and serves the purpose of supplying the gearboxes with the media required for operation, especially a lubricant or a coolant, and with electric power, especially for measuring instruments.

It is advantageous if the compression rolling mill comprises a mill housing with two crossheads and several crossbeams arranged between them.

Each crosshead preferably holds roll adjustment devices that act on one of the two compression rolls.

It is advantageous if each of the crossheads has at least one balancing cylinder for pretensioning the rolling device and for carrying out the shifting movements during roll changes.

It is also advantageous if the crossbeams are provided with tracks for guiding balancing crossheads, the compression rolls, and the gearboxes.

A further advantage is that downwardly directed roll necks are mounted on the compression rolls and are connected by positive locking with a coupling sleeve in the associated gearbox.

The compression rolling mill of the invention consists, for example, of a mill housing with two crossheads and two upper, two middle, and two lower crossbeams. The crossheads each hold at least one roll adjustment device, which operates mechanically, hydraulically, or by a combination of both types of operation. The roll adjustment device acts on both compression rolls and exerts the rolling force that is required to compress the lateral edges of a metal strand.

The two crossheads hold at least one balancing cylinder each, which carries out a balancing, i.e., an almost play-free clamping of the rolling device.

The crossheads are connected by crossbeams, which absorb forces from the roiling process in all three directions in space. In addition, tracks are provided on the upper and lower crossbeams, which guide the balancing crossheads, the compression rolls, and the associated gearboxes. The tracks can be inclined for certain purposes. The balancing cylinders and the roll adjustment device can also be arranged with inclination in order to achieve the optimal force adjustment and for the gearbox of motion.

The balancing crosshead is connected with the balancing cylinder. It is guided here on tracks on the upper crossbeams and is connected with the set of compression rolls by positive locking. During a change of the compression rolls, the balancing crossheads and the gearboxes remain in the compression rolling mill.

The set of compression rolls is pressed against the rolling stock by the roll adjustment. The compression roll is equipped with a downwardly directed roll neck, which is connected by positive locking with a coupling sleeve in the gearbox and thus transmits torque from the gearbox to the roll. The positive locking is created here by a flat roll neck and corresponding flat sections in the coupling sleeve of the gearbox, which are protected by wear plates.

The compression rolls are guided on tracks on the upper crossbeams. The corresponding guides on the compression rolls are rotatable and allow compensation of position differences of the compression rolls relative to the positions in the calibrated state. This makes it possible to avoid constraint and thus the damage to bearings that constraint would cause.

The gearbox is realized with two steps with bevel gear sets and cylindrical gear sets. It is advantageous to guide each gearbox and each coupling sleeve of the compression rolls on tracks on the lower crossbeams that are additionally used in accordance with the invention, so that they can be installed in the compression rolling mill as an individual module. The corresponding guides on the gear cases are rotatable, so that constraint is avoided in the bearings and in the joint, between the compression roll and the gearbox. During a change of the compression rolls, the gearboxes can remain in the compression rolling mill.

The gearboxes follow the adjustment movements of the compression rolls as a result of the positive locking. The joint is equipped, for example, with a centering ring, which allows the gearbox to follow the movement of the compression roll exactly.

Each gearbox is connected by a media chain with the media required for operation and with the electric power supply. The balancing crosshead and the compression rolls are supplied by this media chain.

Each gearbox is connected by a cardan shaft with length compensation by a laterally mounted drive motor. Alternatively, it is possible to use only a single drive motor. The torque distribution is they effected by additional step-up gears. The additional step-up gears are connected at the drive end with a synchronous shaft. The cardan shafts are arranged at the output end of these step-up gears. The synchronous shaft can be multisectional and can be supported by one or more bearing housings.

Splitting the compression rolling mill into a plurality of modules results in improved maintenance and operation and reduced susceptibility to problems compared to the prior art. Design changes can be carried out easily. Essential aspects of the invention include especially the modular construction of the compression roll balancing system, the compression rolls, and the main drive gearbox.

The gearboxes are preferably supported on lower crossbeams with laterally arranged rockers that allow oscillation of the gearboxes corresponding to the movement of the compression roll coupling sleeves. In this regard, the output gears of the gearboxes are each equipped with a separate sleeve for receiving the roll neck of the compression rolls. The sleeves are provided with an outer and an inner polygon for torque transmission. The sleeves are preferably equipped with at least one centering ring that allows the associated gearbox to follow the movement of the respective compression roll exactly.

In summary, the advantages of the invention are that it is simpler to maintain the compression rolling mill and easier to operate it than a conventional compression rolling mill. The compression roiling mill of the invention is more compact than a prior-art compression rolling mill.

Compared to well-known prior-art designs, the compression rolling mill of the invention is less susceptible to problems, and it has smaller individual modules of lower weight and lesser overall widths The drive concept is flexible with respect to the use of a single drive motor or two drive motors.

BRIEF DESCRIPTION OF THE DRAWING

The invention is explained in greater detail below with reference to two specific embodiments.

DETAILED DESCRIPTION OF THE INVENTION

Figure 1:
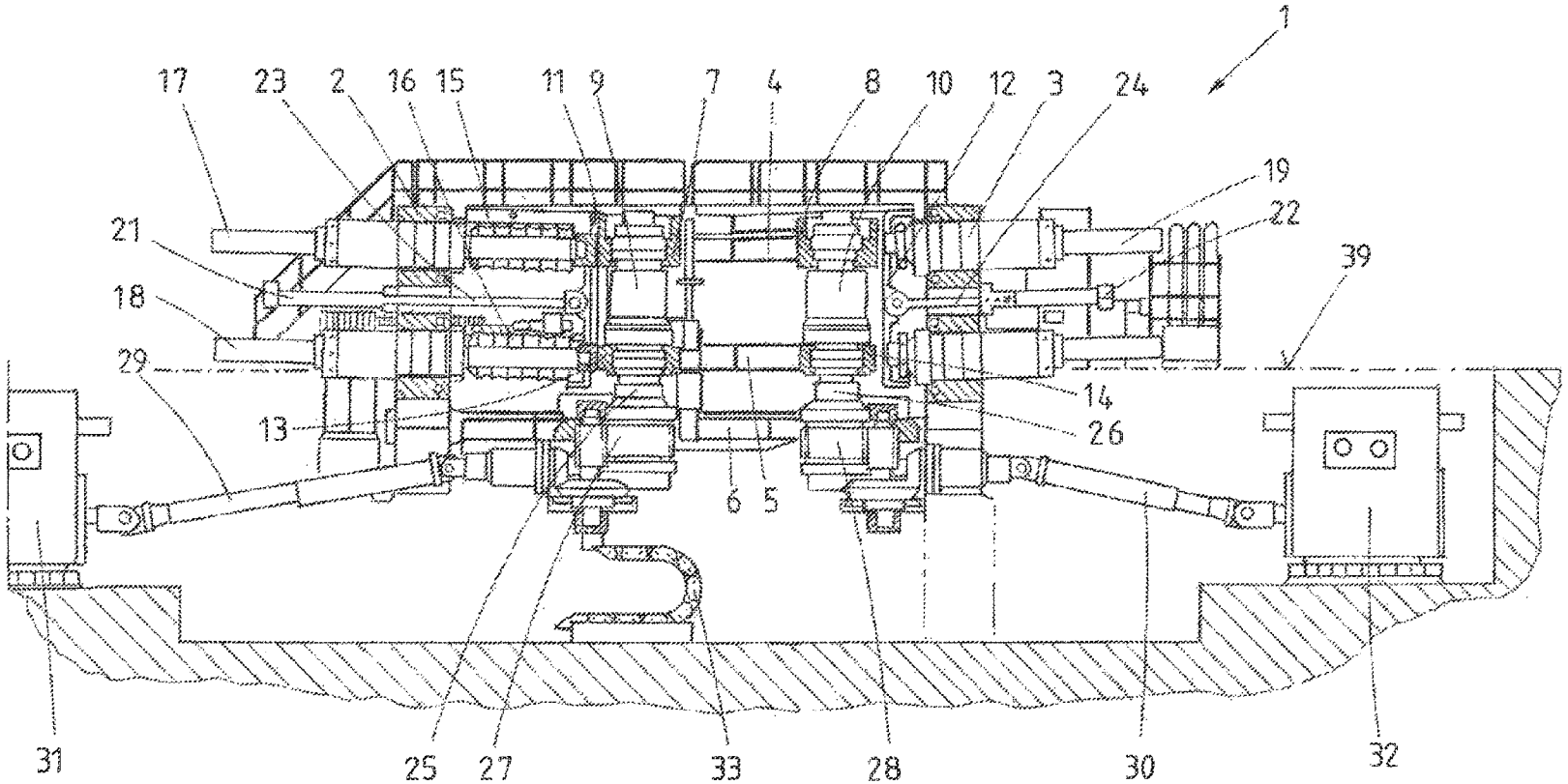
FIG. 1 is a partially cutaway side view of a first embodiment of a compression rolling mill.

A compression rolling mill (FIG. 1) comprises a frame 1 with crossheads 2, 3 and upper, middle, and lower crossbeams 4, 5, and 6. The upper bearing housings 7 of compression rolls 9, 10 are held on balancing crossheads 11, 12 between the upper crossbeams 4. The lower bearing housings 13, 14 of the compression rolls 9, 10 are held by the balancing crossheads 11, 12 in the area of the middle crossbeams 5.

Inclined running tracks 15 are installed on the upper side of the upper crossbeams 4, by which the compression rolls 9, 10, their bearing housings 13, 14, and the balancing crossheads 11, 12 are moved in a way that is already well known. Adjustment devices 17, 18, 19, and 20 press laterally against the bearing housings 13, 14 and the compression rolls 9, 10 that are supported in them, so that the compression rolls 9, 10 in turn are set against the metal strand that is to be rolled. The upper side of the lower crossbeams 6 are provided with running tracks, by which the gearboxes 27, 28 are moved by means of rockers 16. To adjust the exact position of the compression rolls 9, 10 and to avoid play, additional balancing cylinders 21, 22 are arranged between the adjustment drives. The balancing cylinders 21, 22 have piston rods 23, 24 that act on the balancing crossheads 11, 12 and compensate positioning inaccuracies of the adjustment devices 17 to 20.

The compression rolls 9, 10 are equipped with roll necks 25, 26 or coupling sleeves, by which they interact with gear sets 27, 28, which transmit their drive torque to the compression rolls 9, 10. The gear sets 27, 28 comprise cylindrical gears with helical gear wheels and bevel gears; they are each driven by a cardan shaft 29, 30. The cardan shafts 29, 30 can be adjusted in length and angle, so that they can effect adjustments of the compression rolls 9, 10 in the horizontal direction, while on the drive end they each remain connected with drive motors 31, 32 by gearboxes (not shown). A media chain 33 supplies the gear sets 27, 28 and other parts of the compression rolling mill with electric power and with fluid media.

Figure 2:
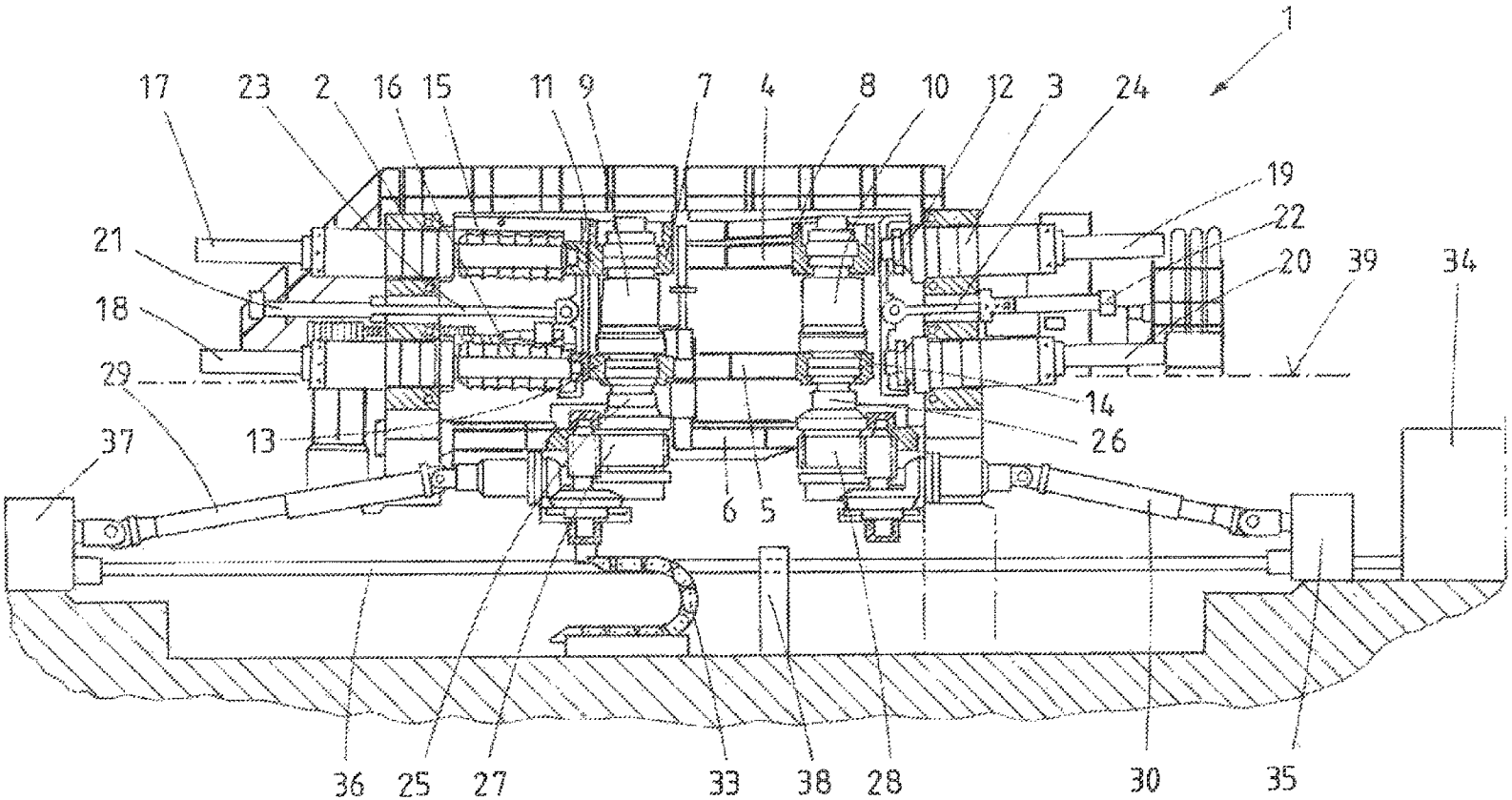
FIG. 2 is a side view of another embodiment of a compression rolling mill.

In another embodiment of the invention (FIG. 2), as an alternative to the use of two drive motors 31, 32, only one drive motor 34 is provided, which drives the cardan shaft 30 directly by a step-up gear 35, while the other cardan shaft 29 is driven by the drive motor 34 via a one-piece or multisectional synchronous shaft 36 and a gearbox 37. As an alternative to this design, it is possible to have a design in which the two cardan shafts 29, 30 have a common gearbox 35, and the cardan shaft 29 is connected with the synchronous shaft 36 only by the gearbox 37, for example, a pinion gear unit. The cardan shaft 30 is connected with the synchronous shaft 36 and the drive motor 34 a gearbox 35, which, for example, is likewise designed as a pinion gear unit. The synchronous shaft 36 is preferably rotatably supported in at least one guide element 38 for stability reasons.

The design of the invention according to both of the illustrated embodiments makes it possible to realize a significant reduction of the overall height of the area below the mill floor level 39 compared to the prior art, since the basement space below the mill floor level 39 requires height space only for the drive motors 31, 32 or the single drive motor 34 and the obliquely mounted cardan shafts 29, 30.

LIST OF REFERENCE NUMBERS

1 frame
2 crosshead
3 crosshead
4 crossbeam
5 crossbeam
6 crossbeam
7 bearing housing
8 bearing housing
9 compression roll
10 compression roll
11 balancing crosshead
12 balancing crosshead
13 bearing housing
14 bearing housing
15 running track
16 rocker
17 adjustment device
18 adjustment device
19 adjustment device
20 adjustment device
21 balancing cylinder
22 balancing cylinder
23 piston rod
24 piston rod
25 roll neck
26 roll neck
27 gear set
28 gear set
29 cardan shaft
30 cardan shaft
31 drive motor
32 drive motor
33 media chain
34 drive motor
35 step-up gear
36 synchronous shaft
37 step-up gear
38 guide element
39 mill floor level

The invention claimed is:

1. A compression rolling mill for laterally compressing a metal strand with a pair of compression rolls (9, 10) that are arranged with their center axes vertical, that can be adjusted relative to each other, and that are connected to a rotary drive (31, 32; 34) by two cardan shafts (29, 30), wherein the two compression rolls (9, 10) are connected with the rotary drive (31, 32; 34) by two gearboxes (27, 28) that are connected to bottom ends of the compression rolls so that the gearboxes can each be adjusted horizontally together with a respective one of the compression rolls (9, 10) and by the cardan shafts (29, 30) connected respectively with one of the two gearboxes (27, 28), where the cardan shafts (29, 30) are inclined at an acute angle to the horizontal.

2. A compression rolling mill in accordance with claim 1, wherein the rotary drive comprises two drive motors (31, 32), each of which is connected with one of the two cardan shafts (29, 30).

3. A compression rolling mill in accordance with claim 1, wherein the two cardan shafts (29, 30) are each connected with gearboxes (35, 37), and a step-up gear (37) belonging to one of the cardan shafts (29) is connected by a synchronous shaft (36) with the drive motor (34) for a common drive of the two step-up gears, or the two cardan shafts (29, 30) are connected with the drive motor (34) by a common step-up gear and a synchronous shaft (36) connected to it.

4. A compression rolling mill in accordance with claim 3, wherein the gearboxes (35, 37) are designed as step-up gears and/or as pinion gear units.

5. A compression rolling mill in accordance with claim 3, wherein the synchronous shaft (36) is supported in at least one guide element (38), by which it is supported relative to the floor.

6. A compression rolling mill in accordance with claim 1, wherein the rotary drive is arranged below a mill floor level (39).

7. A compression rolling mill in accordance with claim 1, wherein a media chain (33) is laid below a mill floor level (39), is connected with the gearboxes (27, 28) arranged between the cardan shafts (29, 30) and the rolls (9, 10), and serves the purpose of supplying the gearboxes (27, 28) with a media required for operation and with electric power.

8. A compression rolling mill in accordance with claim 1, wherein it comprises a mill housing with two crossheads (2, 3) and several crossbeams (4, 5, 6) arranged in pairs between them.

9. A compression rolling mill in accordance with claim 8, wherein each of the crossheads (2, 3) holds roll adjustment devices (17, 18, 19, 20) that act on one of the two compression rolls (9, 10).

10. A compression rolling mill in accordance with claim 9, wherein each of the crossheads (2, 3) has at least one balancing cylinder (21, 22) for pretensioning a rolling device and for carrying out shifting movements during roll changes.

11. A compression rolling mill in accordance with claim 8, wherein the crossbeams (4, 6) are provided with tracks for guiding balancing crossheads (11, 12), the compression rolls (9, 10), and the gearboxes (27, 28).

12. A compression rolling mill in accordance with claim 1, wherein downwardly directed roll necks (25, 26) are mounted on the compression rolls (9, 10) and are connected by positive locking with a coupling sleeve in the associated gearbox (27, 28).

13. A compression rolling mill in accordance with claim 1, wherein the gearboxes (27, 28) have two steps made up of bevel gear sets and cylindrical gear sets.

14. A compression rolling mill in accordance with claim 1, wherein the gearboxes (27, 28) belonging to the compression rolls (9, 10) are guided on tracks on crossbeams (6) and can be installed in the compression rolling mill as an individual modules.

15. A compression rolling mill in accordance with claim 1, wherein the gearboxes (27, 28) are supported on lower crossbeams (6) with laterally arranged rockers (16) that allow oscillation of the gearboxes (27, 28) corresponding to the movement of compression roll coupling sleeves.

16. A compression rolling mill in accordance with claim 1, wherein output gears of the gearboxes (27, 28) are each equipped with a separate sleeve for receiving a roll neck of the compression rolls (9, 10).

17. A compression rolling mill in accordance with claim 16, wherein each sleeve is provided with an outer and an inner polygon for torque transmission.

18. A compression rolling mill in accordance with claim 16, wherein each sleeve is equipped with at least one centering ring that allows the associated gearbox (27, 28) to follow the movement of the respective compression roll (9, 10) exactly.

* * * * *